US009748692B1

(12) United States Patent
Pardo

(10) Patent No.: US 9,748,692 B1
(45) Date of Patent: Aug. 29, 2017

(54) ELECTRICAL CONNECTOR WITH MALE BLADE STABILIZER

(71) Applicant: YAZAKI NORTH AMERICA, INC., Canton, MI (US)

(72) Inventor: Chad Thomas Pardo, Livonia, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 0 days.

(21) Appl. No.: 15/273,906

(22) Filed: Sep. 23, 2016

(51) Int. Cl.
*H01R 13/64* (2006.01)
*H01R 13/629* (2006.01)
*H01R 13/04* (2006.01)
*H01R 13/40* (2006.01)

(52) U.S. Cl.
CPC ..... *H01R 13/629* (2013.01); *H01R 13/04* (2013.01); *H01R 13/40* (2013.01)

(58) Field of Classification Search
CPC ..... H01R 13/629; H01R 13/6272; H01R 13/62938; H01R 13/639; H01R 13/40; H01R 13/4538; H01R 13/04
USPC ..... 439/374
See application file for complete search history.

(56) References Cited

U.S. PATENT DOCUMENTS 6,692,274 B2 2/2004 Maegawa
6,761,568 B2 7/2004 Bakker et al.
7,134,901 B2 * 11/2006 Okura ..... H01R 13/4538 439/140
7,275,943 B2 * 10/2007 Ohtaka ..... H01R 13/62938 439/157
7,396,240 B2 * 7/2008 Frederiksen ..... H01R 13/639 439/157
7,442,058 B2 * 10/2008 Ohtaka ..... H01R 13/6272 439/157
7,588,446 B2 * 9/2009 Kobayashi ..... H01R 13/62933 439/135
7,670,177 B2 3/2010 Myer et al.
9,455,521 B2 * 9/2016 Bang ..... H01R 13/4538
2002/0022391 A1 * 2/2002 Beck ..... H01R 13/62938 439/157
2002/0182908 A1 * 12/2002 Maegawa ..... H01R 13/62938 439/157
2003/0008537 A1 * 1/2003 Nishide ..... H01R 13/4538 439/157

* cited by examiner

*Primary Examiner* — Jean F Duverne
(74) *Attorney, Agent, or Firm* — Foley & Lardner LLP

(57) ABSTRACT

An electrical connector can include a male blade stabilizer that protects one or more male blade terminals from external objects before, during, and after coupling of the male connector to a female connector. The male blade stabilizer can be slidably disposed within a housing of the male connector and configured to retract when the female connector is coupled to the male connector and extend when the female connector is decoupled from the male connector. The male blade stabilizer is moveable from an extended position to a retracted position when a lever lock of a lever is resiliently deflected by the engagement of a female housing with the male housing to a pre-set position.

20 Claims, 3 Drawing Sheets

ELECTRICAL CONNECTOR WITH MALE BLADE STABILIZER

TECHNICAL FIELD

The present application relates generally to the field of electrical wiring connectors, and more particularly to a connector having a selectively engageable male blade stabilizer.

BACKGROUND

Electrical connectors can be used to couple, join or electrically connect various electrical components together to enable data, current, etc. to flow between the electrical components. For example, an electrical component can include one or more electrical wires, which can be joined together at a terminal. The terminal can be configured to mate with a corresponding terminal, in a male-to-female fashion. A male blade terminal is inserted into a female receptacle terminal to electrically couple the male connector to the female connector. In some instances, in-line electrical connectors can be used in motor vehicles due to their compact size. An in-line connector can include a male connector having a male housing that surrounds one or more male blade terminals, and a female connector having a female housing that surrounds one or more female receptacle terminals. When the female connector is coupled to the male connector, the male blade terminals are positioned within the female receptacle terminals, thereby limiting any exposure to external objects, such as fingers and/or other external objects that may contact the male blade terminals. However, when the male connector is not coupled to the female connector, the male blade terminals may be exposed to external objects. Such exposure may result in bending, breaking, or other damage to the male blade terminals, thereby potentially affecting operation of the connector.

SUMMARY

Implementations described herein relate to systems and methods for protecting one or more male blade terminals of a connector from external objects (e.g., fingers, debris, etc.) before, during, and after coupling of the male connector to a female connector. The male blade stabilizer can be slidably disposed within a housing of the male connector and configured to retract when the female connector is coupled to the male connector and extend when the female connector is decoupled from the male connector.

One implementation relates to a connector assembly that includes a male connector having a male housing and a lever rotatably coupled to the male housing. The male housing includes one or more male blade terminals and a male blade stabilizer moveable from an extended position relative to the male housing to a retracted position relative to the male housing. The male blade stabilizer includes one or more openings through which each of the one or more male blade terminals extend when the male blade stabilizer is in the retracted position. The male blade stabilizer protects the one or more male blade terminals when the male blade stabilizer is in the extended position. The male blade stabilizer includes a retention feature. The male connector also includes a lever that includes a lever lock resiliently deflectable relative to the lever. The lever lock is selectively engagable with the retention feature of the male blade stabilizer to restrict movement of the male blade stabilizer relative to the male housing. The connector assembly further includes a female connector configured to selectively engage with the male connector and having a female housing complementary to the male housing of the male connector. The female housing resiliently deflects the lever lock of the lever when the female housing is inserted into the male housing to a pre-set position.

In some implementations, the lever lock includes a notch selectively engaging with the retention feature of the male blade stabilizer. The lever lock can further include a locking face engaging with the retention feature of the male blade stabilizer with the notch. The lever lock can also further include a ramped first surface that engages with the female housing to resiliently deflect the lever lock relative to the lever when the female housing is inserted into the male housing to the pre-set position. A portion of the ramped first surface of the lever lock can selectively engage with the male housing to restrict rotation of the lever relative to the male housing when the female housing is not engaged with the male housing. The portion of the ramped first surface may be disengaged from the male housing when the female housing is inserted into the male housing to the pre-set position. In some implementations, rotation of the lever relative to the male housing urges the female housing from the pre-set position to a full-set position, wherein the male blade stabilizer is in the retracted position when the female housing is in the full-set position. In some implementations, the male housing includes one or more alignment features. In some implementations, the female housing covers the one or more male blade terminals when the male blade stabilizer is moved from the extended position to the retracted position. In some implementations, the male housing and the female housing comprise an electrically insulative material.

Another implementation relates to a connector assembly that includes a male connector having a male housing and a lever rotatably coupled to the male housing. The male housing includes one or more male blade terminals and a male blade stabilizer moveable from an extended position relative to the male housing to a retracted position relative to the male housing. The male blade stabilizer protects the one or more male blade terminals when the male blade stabilizer is in the extended position. The male blade stabilizer includes a retention feature. The male connector also includes a lever that includes a lever lock resiliently deflectable relative to the lever. The lever lock is selectively engagable with the retention feature of the male blade stabilizer to restrict movement of the male blade stabilizer relative to the male housing. The lever lock includes a ramped first surface. The connector assembly further includes a female connector configured to selectively engage with the male connector and having a female housing complementary to the male housing of the male connector. The female housing engages with the ramped first surface to resiliently deflect the lever lock of the lever when the female housing is inserted into the male housing to a pre-set position.

In some implementations, the lever lock includes a notch selectively engaging with the retention feature of the male blade stabilizer. The lever lock can further include a locking face engaging with the retention feature of the male blade stabilizer with the notch. A portion of the ramped first surface of the lever lock can selectively engage with the male housing to restrict rotation of the lever relative to the male housing when the female housing is not engaged with the male housing. The portion of the ramped first surface may be disengaged from the male housing when the female housing is inserted into the male housing to the pre-set position. In some implementations, rotation of the lever relative to the male housing urges the female housing from the pre-set position to a full-set position, wherein the male blade stabilizer is in the retracted position when the female housing is in the full-set position.

A further implementation relates to a connector that includes a male housing, one or more male blade terminals, a male blade stabilizer, and a lever. The male blade stabilizer is moveable from an extended position relative to the male housing to a retracted position relative to the male housing. The male blade stabilizer includes one or more openings through which each of the one or more male blade terminals extend when the male blade stabilizer is in the retracted position. The male blade stabilizer protects the one or more male blade terminals when the male blade stabilizer is in the extended position. The male blade stabilizer includes a retention feature. The lever includes a lever lock resiliently deflectable relative to the lever. The lever lock is selectively engagable with the retention feature of the male blade stabilizer to restrict movement of the male blade stabilizer relative to the male housing. The lever lock of the lever is resiliently deflected relative to the lever when a female housing of a female connector is engaged with the male housing in a pre-set position.

In some implementations, the lever lock includes a notch and a locking face selectively engaging with the retention feature of the male blade stabilizer. The lever lock may further include a ramped first surface that engages with the female housing to resiliently deflect the lever lock relative to the lever when the female housing is inserted into the male housing to the pre-set position. In some implementations, a portion of the ramped first surface of the lever lock selectively engages with the male housing to restrict rotation of the lever relative to the male housing when the female housing is not engaged with the male housing. The portion of the ramped first surface disengages from the male housing when the female housing is inserted into the male housing to the pre-set position

BRIEF DESCRIPTION

The details of one or more implementations are set forth in the accompanying drawings and the description below. Other features, aspects, and advantages of the disclosure will become apparent from the description, the drawings, and the claims, in which:

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for protecting one or more male blade terminals of a connector from external objects before, during, and after coupling of a male connector to a female connector. The various concepts introduced above and discussed in greater detail below may be implemented in any of numerous ways, as the described concepts are not limited to any particular manner of implementation. Examples of specific implementations and applications are provided primarily for illustrative purposes.

Figure 1:
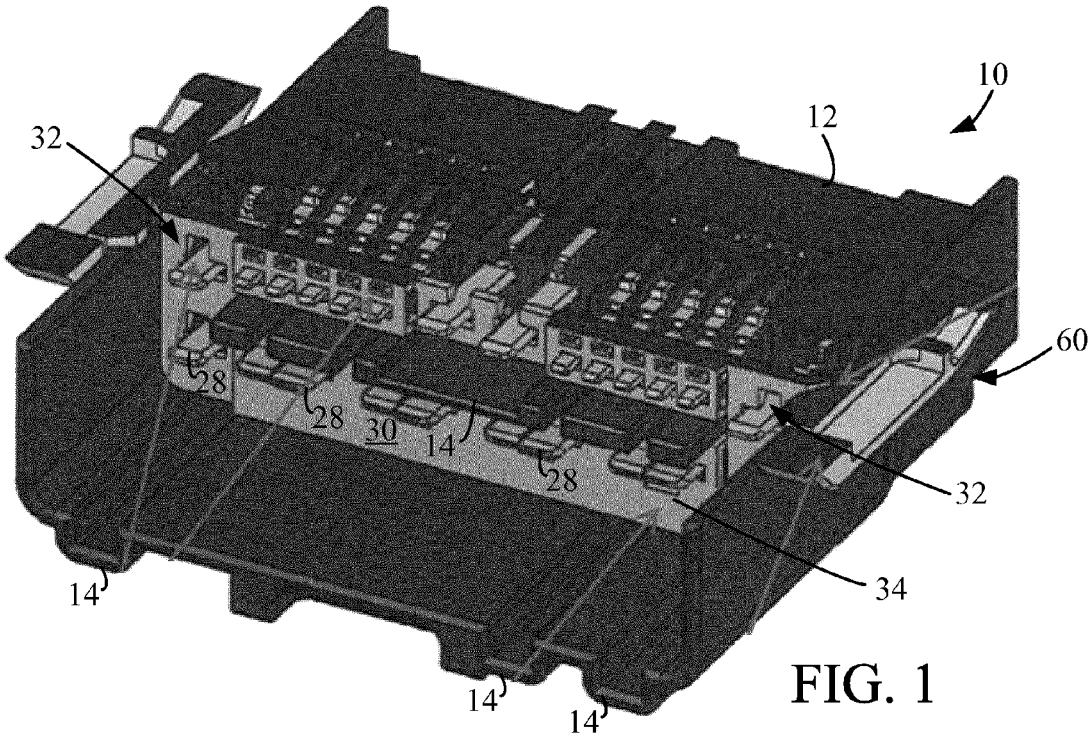
FIG. 1 is a perspective view of a horizontal cross-section of a male connector having a male blade stabilizer shown in an extended position to protect one or more male blade terminals while a female connector is not coupled to the male connector.
Figure 2:
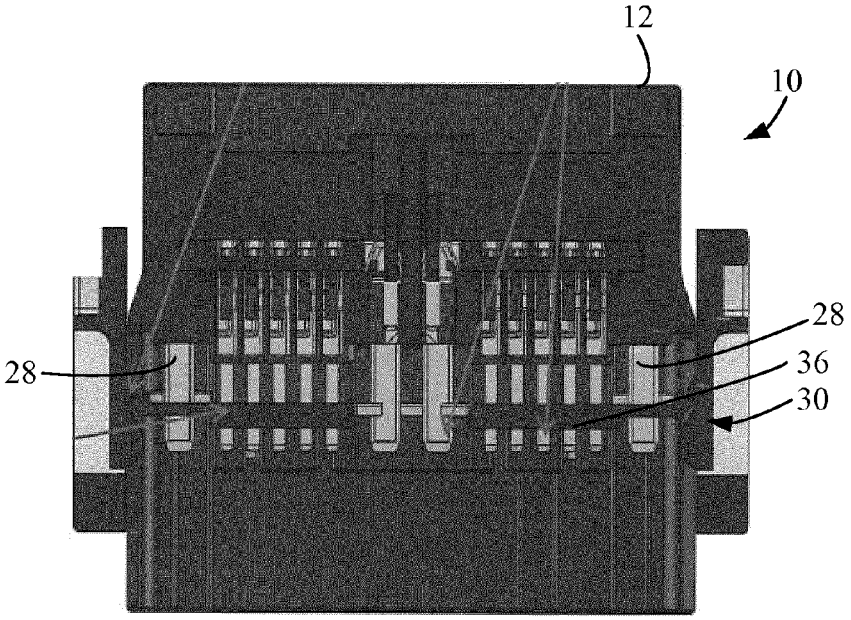
FIG. 2 is a top cross-sectional view of the male connector of FIG. 1 and showing the male blade stabilizer within a housing of the male connector and engaged with the lever.

FIGS. 1-2 depicts an example male connector 10 of a connector assembly that includes a male housing 12 configured to couple to a complementary female housing 52 of a female connector 50 (shown in FIG. 3) of the connector assembly. In some implementations, the male connector 10 may be formed as part of or electrically coupled to wires of a battery. In other implementations, the male connector 10 may be electrically coupled to other electronic components. The male housing 12 can be composed of a suitable electrically insulative material, such as a polymer, and can be manufactured through any suitable technique, such as injection molding. The male housing 12 includes one or more male blade terminals 28 and can include one or more alignment features 14, such as longitudinal extending rails or ledges to insert into complementary openings of the female housing 52 of the female connector 50.

Figure 3:
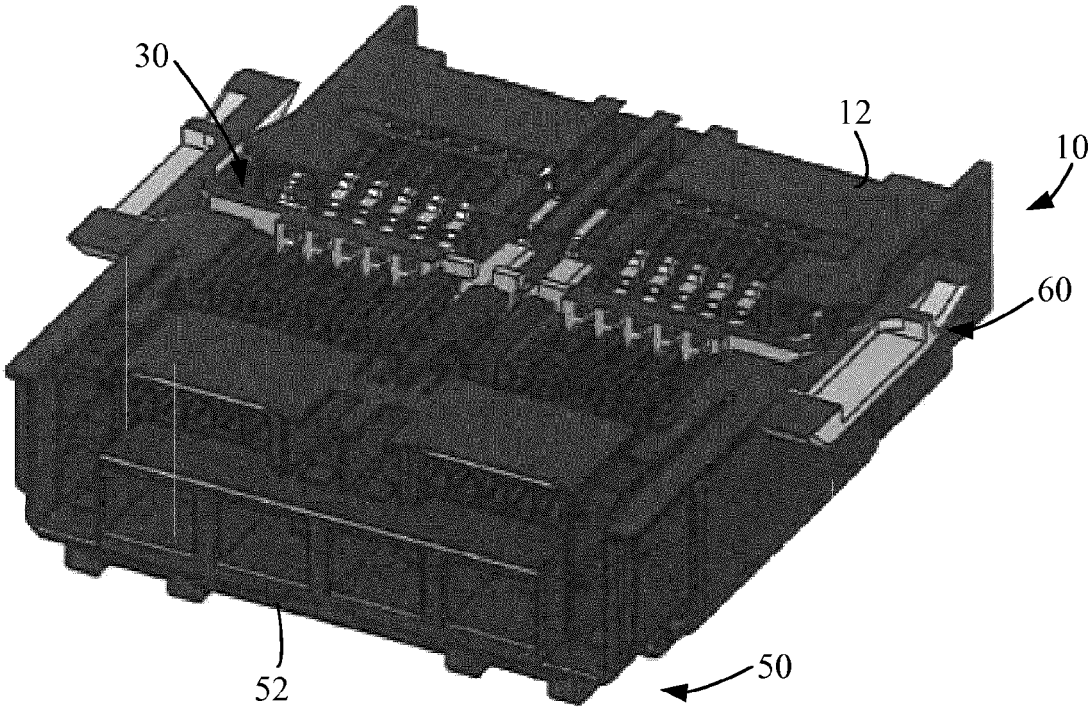
FIG. 3 is a perspective cross-sectional view of the male connector of FIG. 1 with retention features of the housing engaging an inner feature of a housing of a female connector when the female connector is initially coupled to the male connector.
Figure 4:
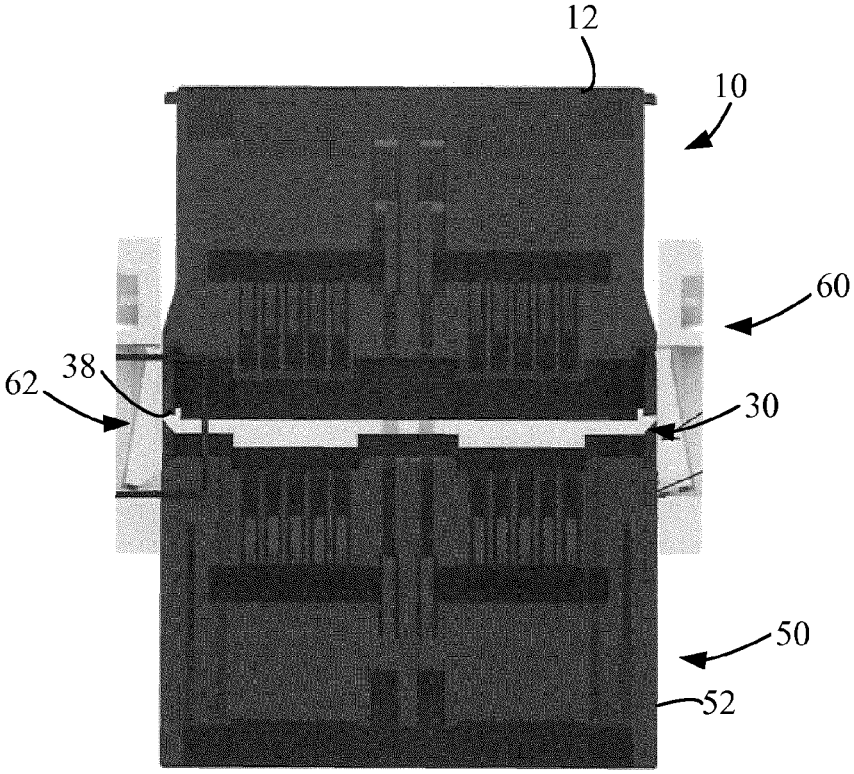
FIG. 4 is a top cross-sectional view of a portion of the male connector of FIG. 3 showing the housing of the female connector engaging the retention features of the lever of the male connector with the male blade stabilizer disengaged.
Figure 6:
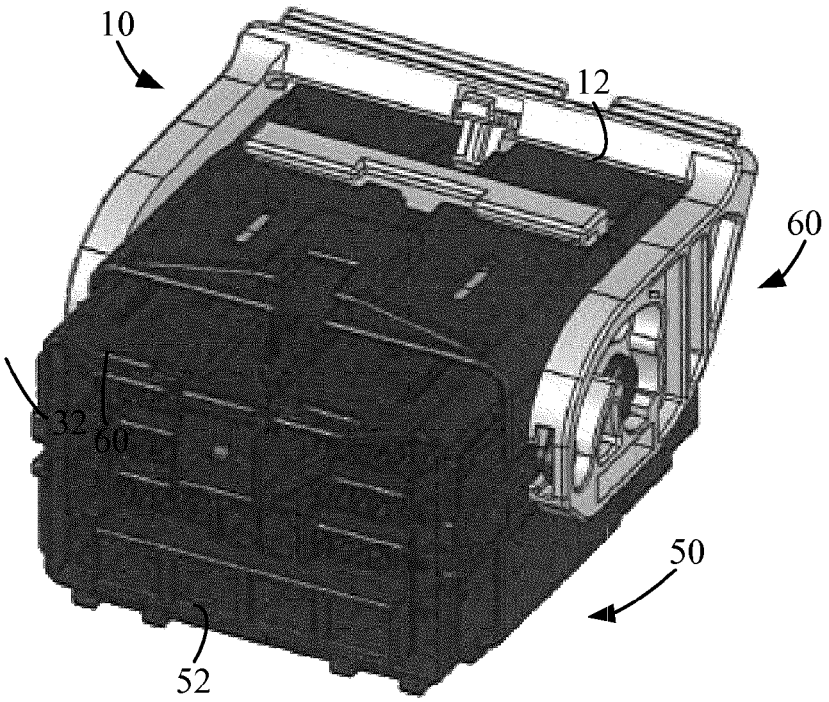
FIG. 6 is a perspective view of the male connector coupled to the female connector with the lever in the pre-set position.

The male housing 12 also includes a male blade stabilizer 30 shown positioned within the male housing 12 in an extended position such that one or more male blade terminals 28 are positioned within one or more openings 32 and are protected by the male blade stabilizer 30. As shown, the one or more male blade terminals 28 can protrude from the one or more openings 32 to permit testing and/or an initial connection to the female terminals of the female connector 50. In some implementations, the one or more openings 32 may include an access hole or may otherwise be sized larger than the one or more male blade terminals 28 to permit the testing and/or servicing of the one or more male blade terminals 28 without disassembly of the male connector 10. When the female connector 50 is initially inserted into the male connector 10 in the pre-set position, such as shown in FIGS. 3-4 and 6, the protrusion of the one or more male blade terminals 28 permits electrical coupling to the one or more complementary female terminals prior to actuating a lever 60 of the male connector 10 to fully engage the male connector 10 to the female connector 50 in a full-set position. In the implementation shown, the male blade stabilizer 30 substantially covers the one or more male blade terminals 28 while the male connector 10 is disengaged from the female connector 50 to reduce the likelihood of debris or damage to the one or more male blade terminals 28. The male blade stabilizer 30 can also be composed of a suitable electrically insulative material, such as a polymer, and can be manufactured through any suitable technique, such as injection molding. The male blade stabilizer 30 includes an outer face 34 through which the one or more openings 32 extend to allow the male blade terminals 28 to selectively extend through. The male blade stabilizer 30 includes a body portion 36 (shown in FIGS. 2-4) through which the one or more openings 32 also extend and that may be sized to provide added support for the male blade terminals 28 when the male blade stabilizer 30 is both in the extended position and/or the retracted position.

As noted above, a lever 60, is rotatably coupled to the male housing 12. The lever 60 is configured to rotate about an axis perpendicular to a longitudinal axis along which the female connector 50 is mated to the male connector 10. The lever 60 engages one or more protrusions or other features of the female connector 50 to urge the male connector 10 and female connector 50 together. For instance, the lever 60 may include an arcuate notched path (e.g., inwardly spiraling) into which a protrusion of the female connector 50 may initially enter when the female connector 50 is initially engaged with the male connector 10 in the pre-set position. As the lever 60 is actuated, such as by rotating relative to the male housing 12, the arcuate notched path can engage with the protrusion of the female connector 50 to urge the female connector 50 toward the male connector 10 as the lever 60 is rotated. Of course other features for the lever 60 to urge the male connector 10 and female connector 50 toward each other from the pre-set position may also be implemented, such as a peg and hole design, a lever and fulcrum, etc.

As shown in greater detail in FIGS. 3-6, the lever 60 includes a lever lock 62 that engages a retention feature 38 of the male blade stabilizer 30. In some implementations, the lever lock 62 may also engage with the male housing 12 to prevent and/or restrict rotation of the lever 60 relative to the male housing 12. As shown best in FIG. 5, the lever lock 62 includes a main body 64 that is resiliently coupled to the lever 60, such as a molded polymer component. The main body 64 includes a ramped first surface 66, a notch 68, and a retention protrusion 70. The ramped first surface 66 is configured to engage with and resiliently deflect away from a portion of the female housing 52 as the female connector 50 is inserted into the male housing 12 of the male connector 10. In some implementations, a portion of the ramped first surface 66 may also be configured to engage with an opening or notch in the male housing 12 to restrict or limit movement of the lever 60 relative to the male housing 12 when the female connector 50 is not in the pre-set position.

Figure 5:
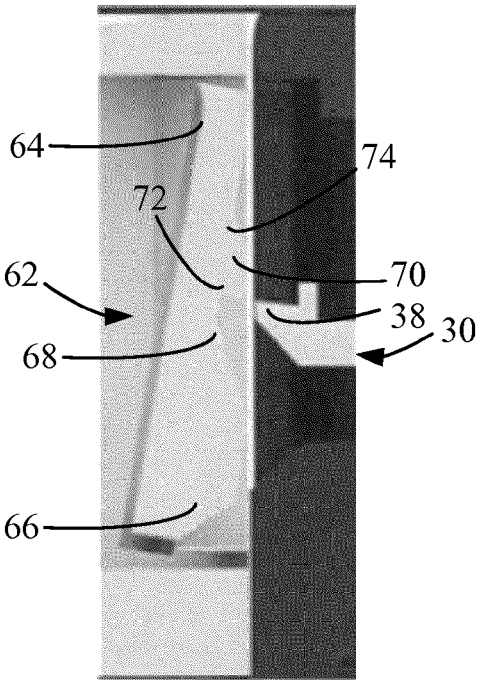
FIG. 5 is a magnified view of a portion of a lever lock of the lever of the male connector of FIG. 4 in greater detail.

The notch 68 is distal to the ramped first surface 66 and is configured to engage with and retain the retention feature 38 of the male blade stabilizer 30 in the extended position while the female housing 52 is not inserted into the male housing 12. The notch 68 of the lever lock 62 can prevent and/or restrict the male blade stabilizer 30 from being moved longitudinally outward or proximal relative to the male housing 12. The retention protrusion 70 forms a locking face 72 with the notch 68 to restrict the movement of the retention feature 38 of the male blade stabilizer 30 from moving longitudinally or distally relative to the male housing 12 from the extended position to the retracted position while the female housing 52 is not inserted into the male housing 12. The locking face 72 shown in FIG. 5 is a flat wall against which the retention feature 38 of the male blade stabilizer 30 abuts when the female housing 52 is not inserted into the male housing 12. Thus, the flat wall can provide substantial resistant to distal movement of the male blade stabilizer 30 relative to the male housing 12. Thus, in the pre-set position, the male blade stabilizer 30 is cooperatively held from moving in the longitudinal direction by both the notch 68 and the locking face 72 interfacing with the retention feature 38 of the male blade stabilizer 30. The male blade stabilizer 30 is further prevented from moving laterally or vertically by the male housing 12. Accordingly, until the female connector 50 engages with the male connector 10, the male blade stabilizer 30 is held in the pre-set position to cover and protect the one or more male blade terminals 28. The retention protrusion 70 also includes a ramped second surface 74 to permit the retention feature 38 of the male blade stabilizer 30 to be returned to the extended position from the retracted position after the female housing 52 is disengaged from the male housing 12.

Referring generally to FIGS. 3-6, the female housing 52 of the female connector 50 is initially engaged with the male housing 12 of the male connector 10 by inserting the female connector 50 into the male connector 10 to the pre-set position, shown in FIGS. 3-4. As the female housing 52 is inserted to the pre-set position, the female housing 52 engages with the ramped first surface 64 of the lever lock 62 to resiliently deflect the lever lock 62 away from the portion of the female housing 52 until the locking face 72 is clear of the retention feature 38 of the male blade stabilizer 30, shown in FIG. 5. In some implementations, the ramped first surface 66 may also clear an opening or notch in the male housing 12 that restricts or limits movement of the lever 60 relative to the male housing 12.

Once the locking face 72 is disengaged from and clear of the retention feature 38 of the male blade stabilizer 30, the male blade stabilizer 30 can be moved longitudinally or distally relative to the male housing 12 to expose more of the body of the one or more male blade terminals 28 that were previously protected by the male blade stabilizer 30 when the male blade stabilizer 30 was in the extended position. The female housing 52 covers and protects the one or more male blade terminals 28 as the female connector 50 is engaged with the male connector 10 as the male blade stabilizer 30 is moved distally.

The lever 60 may be rotated after the female connector 50 and the male connector 10 are positioned in the pre-set position. The rotation of the lever 60 urges the female connector 50 and the male connector 10 together to further seat, electrically couple, and lock the female connector 50 and the male connector 10 together in a full-set position. In some implementations, the lever 60 can be locked or otherwise secured to maintain the female connector 50 and the male connector 10 in the full-set position.

When the male connector 10 and the female connector 50 are to be unmated, the lever 60 is rotated in an opposite direction to urge the female connector 50 and the male connector 10 away from each other. In some implementations, the lever lock 62 can include an arcuate ramp adjacent (e.g., spiraling) or near to the retention protrusion 70 to engage with and urge the retention feature 38 of the male blade stabilizer longitudinally outward or proximal relative to the male housing 12. That is, the arcuate ramp can push the male blade stabilizer 30 outwardly relative to the male housing 12 as the lever 60 is rotated to disengage the female connector 50 from the male connector 10. Thus, the retention feature 38 and male blade stabilizer 30 can be returned to the pre-set position shown in FIG. 5. As the female housing 52 is removed from the male housing 12, the lever lock 70 resiliently returns to a locked position, such as that shown in FIGS. 1-2. Accordingly, the male blade stabilizer 30 can be returned to the extended position and secured in the notch 68 of the lever lock 70 after the female connector 50 is disconnected.

The lever lock 70 engagement with the retention feature 38 of the male blade stabilizer 30 advantageously reduces the connection force required to couple the female connector 50 to the male connector 10 by utilizing the resilient deformation of the lever lock 70 to secure and release the retention feature 38 of the male blade stabilizer 30. Thus, the notch 68 and locking face 72 can be configured to more securely retain and restrict movement of the male blade stabilizer 30 as the connection force only needs to deflect the lever lock 70 and does not need to overcome the engagement of the notch 68 and locking face 72 with the retention feature 38 of the male blade stabilizer 30. Further, the lever lock 70 permits less material for the male blade stabilizer 30 to be used as the male blade stabilizer 30 utilizes less features for retention. In addition, the protrusion of the one or more male blade terminals 28 from the male blade stabilizer 30 and/or the access holes permit testing of the one or more male blade terminals 28 without requiring disassembly of the male connector 10. Further still, the one or more male blade terminals 28 are not held straight by the male blade stabilizer 30 and the male blade stabilizer 30 does not provide scoop or fingerproof protection. Rather, the male blade stabilizer 30 positions the one or more male blade terminals 28 in a mate-ably acceptable position.

The above features can have various implementations. For instance, a connector assembly can include a male connector having a male housing and a lever rotatably coupled to the male housing. The male housing includes one or more male blade terminals and a male blade stabilizer moveable from an extended position relative to the male housing to a retracted position relative to the male housing. The male blade stabilizer includes one or more openings through which each of the one or more male blade terminals extend when the male blade stabilizer is in the retracted position. The male blade stabilizer protects the one or more male blade terminals when the male blade stabilizer is in the extended position. The male blade stabilizer includes a retention feature. The male connector also includes a lever that includes a lever lock resiliently deflectable relative to the lever. The lever lock is selectively engagable with the retention feature of the male blade stabilizer to restrict movement of the male blade stabilizer relative to the male housing. The connector assembly further includes a female connector configured to selectively engage with the male connector and having a female housing complementary to the male housing of the male connector. The female housing resiliently deflects the lever lock of the lever when the female housing is inserted into the male housing to a pre-set position.

In some implementations, the lever lock includes a notch selectively engaging with the retention feature of the male blade stabilizer. The lever lock can further include a locking face engaging with the retention feature of the male blade stabilizer with the notch. The lever lock can also further include a ramped first surface that engages with the female housing to resiliently deflect the lever lock relative to the lever when the female housing is inserted into the male housing to the pre-set position. A portion of the ramped first surface of the lever lock can selectively engage with the male housing to restrict rotation of the lever relative to the male housing when the female housing is not engaged with the male housing. The portion of the ramped first surface may be disengaged from the male housing when the female housing is inserted into the male housing to the pre-set position. In some implementations, rotation of the lever relative to the male housing urges the female housing from the pre-set position to a full-set position, wherein the male blade stabilizer is in the retracted position when the female housing is in the full-set position. In some implementations, the male housing includes one or more alignment features. In some implementations, the female housing covers the one or more male blade terminals when the male blade stabilizer is moved from the extended position to the retracted position. In some implementations, the male housing and the female housing comprise an electrically insulative material.

Another connector assembly can include a male connector having a male housing and a lever rotatably coupled to the male housing. The male housing includes one or more male blade terminals and a male blade stabilizer moveable from an extended position relative to the male housing to a retracted position relative to the male housing. The male blade stabilizer protects the one or more male blade terminals when the male blade stabilizer is in the extended position. The male blade stabilizer includes a retention feature. The male connector also includes a lever that includes a lever lock resiliently deflectable relative to the lever. The lever lock is selectively engagable with the retention feature of the male blade stabilizer to restrict movement of the male blade stabilizer relative to the male housing. The lever lock includes a ramped first surface. The connector assembly further includes a female connector configured to selectively engage with the male connector and having a female housing complementary to the male housing of the male connector. The female housing engages with the ramped first surface to resiliently deflect the lever lock of the lever when the female housing is inserted into the male housing to a pre-set position.

In some implementations, the lever lock includes a notch selectively engaging with the retention feature of the male blade stabilizer. The lever lock can further include a locking face engaging with the retention feature of the male blade stabilizer with the notch. A portion of the ramped first surface of the lever lock can selectively engage with the male housing to restrict rotation of the lever relative to the male housing when the female housing is not engaged with the male housing. The portion of the ramped first surface may be disengaged from the male housing when the female housing is inserted into the male housing to the pre-set position. In some implementations, rotation of the lever relative to the male housing urges the female housing from the pre-set position to a full-set position, wherein the male blade stabilizer is in the retracted position when the female housing is in the full-set position.

A connector can include a male housing, one or more male blade terminals, a male blade stabilizer, and a lever. The male blade stabilizer is moveable from an extended position relative to the male housing to a retracted position relative to the male housing. The male blade stabilizer includes one or more openings through which each of the one or more male blade terminals extend when the male blade stabilizer is in the retracted position. The male blade stabilizer protects the one or more male blade terminals when the male blade stabilizer is in the extended position. The male blade stabilizer includes a retention feature. The lever includes a lever lock resiliently deflectable relative to the lever. The lever lock is selectively engagable with the retention feature of the male blade stabilizer to restrict movement of the male blade stabilizer relative to the male housing. The lever lock of the lever is resiliently deflected relative to the lever when a female housing of a female connector is engaged with the male housing in a pre-set position.

In some implementations, the lever lock includes a notch and a locking face selectively engaging with the retention feature of the male blade stabilizer. The lever lock may further include a ramped first surface that engages with the female housing to resiliently deflect the lever lock relative to the lever when the female housing is inserted into the male housing to the pre-set position. In some implementations, a portion of the ramped first surface of the lever lock selectively engages with the male housing to restrict rotation of the lever relative to the male housing when the female housing is not engaged with the male housing. The portion of the ramped first surface disengages from the male housing when the female housing is inserted into the male housing to the pre-set position While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, the separation of various system components in the implementations described above should not be understood as requiring such separation in all implementations, and it should be understood that the described components and systems can generally be integrated in a single product or packaged into multiple products.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A connector assembly comprising:

a male connector having a male housing and a lever rotatably coupled to the male housing, the male housing including:

one or more male blade terminals, and a male blade stabilizer moveable from an extended position relative to the male housing to a retracted position relative to the male housing, the male blade stabilizer including one or more openings through which each of the one or more male blade terminals extend when the male blade stabilizer is in the retracted position, the male blade stabilizer protecting the one or more male blade terminals when the male blade stabilizer is in the extended position, the male blade stabilizer including a retention feature, the lever including a lever lock resiliently deflectable relative to the lever, the lever lock selectively engaging with the retention feature of the male blade stabilizer to restrict movement of the male blade stabilizer relative to the male housing; and a female connector configured to selectively engage with the male connector and having a female housing complementary to the male housing of the male connector, the female housing resiliently deflecting the lever lock of the lever when the female housing is inserted into the male housing to a pre-set position.

2. The connector assembly of claim 1, wherein the lever lock includes a notch selectively engaging with the retention feature of the male blade stabilizer.

3. The connector assembly of claim 2, wherein the lever lock further includes a locking face engaging with the retention feature of the male blade stabilizer with the notch.

4. The connector assembly of claim 3, wherein the lever lock further includes a ramped first surface, the ramped first surface engaging with the female housing to resiliently deflect the lever lock relative to the lever when the female housing is inserted into the male housing to the pre-set position.

5. The connector assembly of claim 4, wherein a portion of the ramped first surface of the lever lock selectively engages with the male housing to restrict rotation of the lever relative to the male housing when the female housing is not engaged with the male housing.

6. The connector assembly of claim 5, wherein the portion of the ramped first surface is disengaged from the male housing when the female housing is inserted into the male housing to the pre-set position.

7. The connector assembly of claim 1, wherein rotation of the lever relative to the male housing urges the female housing from the pre-set position to a full-set position, wherein the male blade stabilizer is in the retracted position when the female housing is in the full-set position.

8. The connector assembly of claim 1, wherein the male housing includes one or more alignment features.

9. The connector assembly of claim 1, wherein the female housing covers the one or more male blade terminals when the male blade stabilizer is moved from the extended position to the retracted position.

10. The connector assembly of claim 1, wherein the male housing and the female housing comprise an electrically insulative material.

11. A connector assembly comprising:

a male connector having a male housing and a lever rotatably coupled to the male housing, the male housing including:

one or more male blade terminals, and a male blade stabilizer moveable from an extended position relative to the male housing to a retracted position relative to the male housing, the male blade stabilizer protecting the one or more male blade terminals when the male blade stabilizer is in the extended position, the male blade stabilizer including a retention feature, the lever including a lever lock resiliently deflectable relative to the lever, the lever lock selectively engaging with the retention feature of the male blade stabilizer to restrict movement of the male blade stabilizer relative to the male housing, the lever lock including a ramped first surface; and a female connector configured to selectively engage with the male connector and having a female housing complementary to the male housing of the male connector, the female housing engaging with the ramped first surface to resiliently deflect the lever lock relative to the lever when the female housing is inserted into the male housing to a pre-set position.

12. The connector assembly of claim 11, wherein the lever lock includes a notch selectively engaging with the retention feature of the male blade stabilizer.

13. The connector assembly of claim 12, wherein the lever lock further includes a locking face engaging with the retention feature of the male blade stabilizer with the notch.

14. The connector assembly of claim 11, wherein a portion of the ramped first surface of the lever lock selectively engages with the male housing to restrict rotation of the lever relative to the male housing when the female housing is not engaged with the male housing.

15. The connector assembly of claim 11, wherein the portion of the ramped first surface is disengaged from the male housing when the female housing is inserted into the male housing to the pre-set position.

16. The connector assembly of claim 11, wherein rotation of the lever relative to the male housing urges the female housing from the pre-set position to a full-set position, wherein the male blade stabilizer is in the retracted position when the female housing is in the full-set position.

17. A connector comprising:

a male housing;

one or more male blade terminals;

a male blade stabilizer moveable from an extended position relative to the male housing to a retracted position relative to the male housing, the male blade stabilizer including one or more openings through which each of the one or more male blade terminals extend when the male blade stabilizer is in the retracted position, the male blade stabilizer protecting the one or more male blade terminals when the male blade stabilizer is in the extended position, the male blade stabilizer including a retention feature; and a lever including a lever lock resiliently deflectable relative to the lever, the lever lock selectively engaging with the retention feature of the male blade stabilizer to restrict movement of the male blade stabilizer relative to the male housing;

wherein the lever lock of the lever is resiliently deflected relative to the lever when a female housing of a female connector is engaged with the male housing in a pre-set position.

18. The connector of claim 17, wherein the lever lock includes a notch and a locking face selectively engaging with the retention feature of the male blade stabilizer.

19. The connector of claim 18, wherein the lever lock further includes a ramped first surface, the ramped first surface engaging with the female housing to resiliently deflect the lever lock relative to the lever when the female housing is inserted into the male housing to the pre-set position.

20. The connector of claim 17, wherein a portion of the ramped first surface of the lever lock selectively engages with the male housing to restrict rotation of the lever relative to the male housing when the female housing is not engaged with the male housing, the portion of the ramped first surface disengaging from the male housing when the female housing is inserted into the male housing to the pre-set position.

* * * * *